US008418979B2

(12) United States Patent
Swisher

(10) Patent No.: US 8,418,979 B2
(45) Date of Patent: Apr. 16, 2013

(54) RIGGING DEVICE

(76) Inventor: John R. Swisher, Mesa, AZ (US)

( * ) Notice: Subject to any disclaimer, the term of this patent is extended or adjusted under 35 U.S.C. 154(b) by 4 days.

(21) Appl. No.: 12/883,533

(22) Filed: Sep. 16, 2010

(65) Prior Publication Data

US 2011/0006555 A1 Jan. 13, 2011

Related U.S. Application Data

(63) Continuation of application No. 12/163,699, filed on Jun. 27, 2008, now abandoned.

(60) Provisional application No. 60/959,678, filed on Jul. 16, 2007.

(51) Int. Cl.
*A47H 1/10* (2006.01)
*B66C 1/00* (2006.01)

(52) U.S. Cl.
USPC ..... 248/317; 248/340; 294/81.3; 294/81.52

(58) Field of Classification Search ..... 248/317, 248/320, 322, 339, 340; 294/81.55, 81.56, 294/81.61, 81.3, 106, 81.52, 81.53, 8.51, 294/153, 205; 212/175, 178, 195
See application file for complete search history.

(56) References Cited

U.S. PATENT DOCUMENTS

| | | | | |
|---|---|---|---|---|
| 2,832,748 | A * | 4/1958 | Myers et al. | 525/194 |
| 3,006,591 | A * | 10/1961 | Somes, Jr. | 248/317 |
| 3,499,563 | A | 3/1970 | Forry et al. | |
| 3,561,717 | A * | 2/1971 | Frederick et al. | 248/317 |
| 3,848,659 | A | 11/1974 | Keagy | |
| 4,544,119 | A | 10/1985 | Kellet et al. | |
| 4,676,542 | A | 6/1987 | Besold | |
| 5,037,151 | A * | 8/1991 | Kameyama et al. | 294/81.55 |
| 5,052,734 | A | 10/1991 | Hasegawa et al. | |
| 5,072,734 | A * | 12/1991 | Takeuchi | 600/441 |
| 6,991,274 | B2 * | 1/2006 | Brooks | 294/81.51 |
| 7,093,729 | B2 | 8/2006 | Monteil et al. | |
| 7,455,338 | B2 | 11/2008 | Jenney | |
| 7,997,634 | B2 * | 8/2011 | Piispanen et al. | 294/81.56 |
| 2003/0222468 | A1 * | 12/2003 | Brooks | 294/81.5 |
| 2004/0256342 | A1 | 12/2004 | Monteil et al. | |
| 2007/0080549 | A1 | 4/2007 | Jenney | |
| 2011/0006555 | A1 * | 1/2011 | Swisher | 294/81.53 |

* cited by examiner

*Primary Examiner* — Tan Le
(74) *Attorney, Agent, or Firm* — Sherrill Law Offices, PLLC

(57) ABSTRACT

A rigging device includes a fixture having opposed first and second ends, opposed upper and lower faces, and a bracket extending away from the upper face of the fixture between the opposed first and second ends of the fixture to engage a hoist line of a crane. A support is mounted to the fixture proximate each of the opposed first and second ends on either side of the bracket extending away from the lower face of the fixture terminating with an engaging element movable between a disengaging position and an engaging position.

2 Claims, 7 Drawing Sheets

RIGGING DEVICE

CROSS-REFERENCE TO RELATED APPLICATION

This application claims the benefit of U.S. Provisional Patent Application Ser. No. 60/959,678, filed Jul. 16, 2007.

FIELD OF THE INVENTION

The present invention relates to rigging devices used to secure loads in lifting operations.

BACKGROUND OF THE INVENTION

The lifting of heavy equipment with cranes is inherently dangerous. Of particular significance is the lifting of long, heavy beams, such as long, heavy, metal or steel beams, with cranes. Lifting a long, heavy beam with a crane is difficult because it is unwieldy, and must be attached to the hoist line of a crane carefully to ensure the weight of the beam is balanced relative to the lifting axis of the hoist line to prevent the beam from shifting or displacing during lifting. This is particularly important in steel girder operations where precise placement for installation is required, such as in the building of the steel infrastructure of buildings, bridges, and the like. The challenge of providing a reliable and quick coupling and decoupling between the hoist line of a crane and long, heavy stock further contributes to the difficultly of safely, rapidly, and efficiently repeatedly lifting large amounts of long, heavy stock.

SUMMARY OF THE INVENTION

It is an object of the invention to provide a rigging device used to secure long, heavy loads or stock, such as long, heavy metal or steel beams, joist, girders, trusses, and the like, to a hoist line of a crane which is low in cost, which is safe, which is constructed and arranged to quickly and efficiently secure and release loads, and which is easy to use and highly reliable.

According to the principle of the invention, a rigging device includes a fixture having opposed first and second ends, opposed upper and lower faces, and a bracket extending away from the upper face of the fixture between the opposed first and second ends of the fixture to engage a hoist line of a crane. A support is mounted to the fixture proximate each of the opposed first and second ends on either side of the bracket extending away from the lower face of the fixture to an engaging element movable between a disengaging position and an engaging position. The engaging elements are movable between the disengaging and engaging positions in response to rotation of the respective supports. There is an operative coupling between the supports, wherein rotation of one of the supports imparts rotation to the other one of the supports. A linkage coupled between the supports forms the operative coupling between the supports. A locking mechanism is formed between one of the supports and the fixture preventing rotation of the one of the supports in response to a load applied against the engaging element of the one of the supports in the engaging position thereof in a direction away from the lower face of the fixture. The locking mechanism consists of a first abutment carried by the one of the supports and a second abutment carried by the fixture. A lever is attached to one of the supports to rotate the one of the supports, in which the operative coupling between the supports imparts rotation of the other one of the supports in response to rotation of the one of the supports with the lever.

According to the principle of the invention, a rigging device includes a fixture having opposed first and second ends, opposed upper and lower faces, and a bracket extending away from the upper face of the fixture between the opposed first and second ends of the fixture to engage a hoist line of a crane, the bracket having a first side directed toward the first end of the fixture and a second side directed toward the second end of the fixture. The rigging device is formed with substantially coextensive first and second supports. The first support is mounted to the fixture, between the first end of the fixture and the first side of the bracket extending away from the lower face of the fixture to a first engaging element, for rotation between a first position disposing the first engaging element in a disengaging position, and a second position disposing the first engaging element in an engaging position. The second is support mounted to the fixture, between the second end of the fixture and the second side of the bracket extending away from the lower face of the fixture to a second engaging element, for rotation between a first position disposing the second engaging element in a disengaging position, and a second position disposing the second engaging element in an engaging position. The first support is operatively coupled to the second support, whereby rotation of the first support imparts rotation to the second support. A linkage coupled between the first and second supports forms the operative coupling between the first and second supports. A locking mechanism is formed between the first support and the fixture preventing rotation of the first support in response to a load applied against the first engaging element of the first support in the engaging position thereof in a direction away from the lower face of the fixture. The locking mechanism includes a first abutment carried by the first support and a second abutment carried by the fixture. A lever is attached to one of the first and second supports, in which the operative coupling between the first and second supports imparts rotation to each of the first and second supports in response to movement of the lever.

According to the principle of the invention, a rigging device includes a fixture having opposed first and second ends, opposed upper and lower faces, and a bracket extending away from the upper face of the fixture between the opposed first and second ends of the fixture to engage a hoist line of a crane, the bracket having a first side directed toward the first end of the fixture and a second side directed toward the second end of the fixture. The rigging device is formed with a first support having a first extremity and an opposed second extremity formed with a first engaging element, and a second support having a third extremity and an opposed fourth extremity formed with a second engaging element. The first support is mounted to the fixture between the first end of the fixture and the first side of the bracket for rotation between a first position disposing the first engaging element in a disengaging position, and a second position disposing the first engaging element in an engaging position, the first extremity of the first support extending away from the upper face of the fixture and the second extremity of the support extending away from the lower face of the fixture. The second support is mounted to the fixture between the second end of the fixture and the second side of the bracket for rotation between a first position disposing the second engaging element in a disengaging position, and a second position disposing the second engaging element in an engaging position, the third extremity of the first support extending away from the upper face of the fixture and the fourth extremity of the support extending away from the lower face of the fixture. The first extremity of the first support is operatively coupled to the third extremity of the second support, whereby rotation of the first support imparts rotation to the second support. A linkage coupled between the first extremity of the first support and the third extremity of the second support forms the operative coupling between the first extremity of the first support and the third extremity of the second support. A locking mechanism is formed between the first support and the fixture preventing rotation of the first support in response to a load applied against the first engaging element of the first support in the engaging position thereof in a direction away from the lower face of the fixture. The locking mechanism includes a first abutment carried by the first support and a second abutment carried by the fixture. The first abutment is formed in the first support adjacent to the first extremity of the first support. A lever is attached to the first support, in which the operative coupling between the first and second supports imparts rotation of the second support in response to rotation of the first support with the lever.

BRIEF DESCRIPTION OF THE DRAWINGS

Referring to the drawings.

DETAILED DESCRIPTION OF A PREFERRED EMBODIMENT

Figure 1:
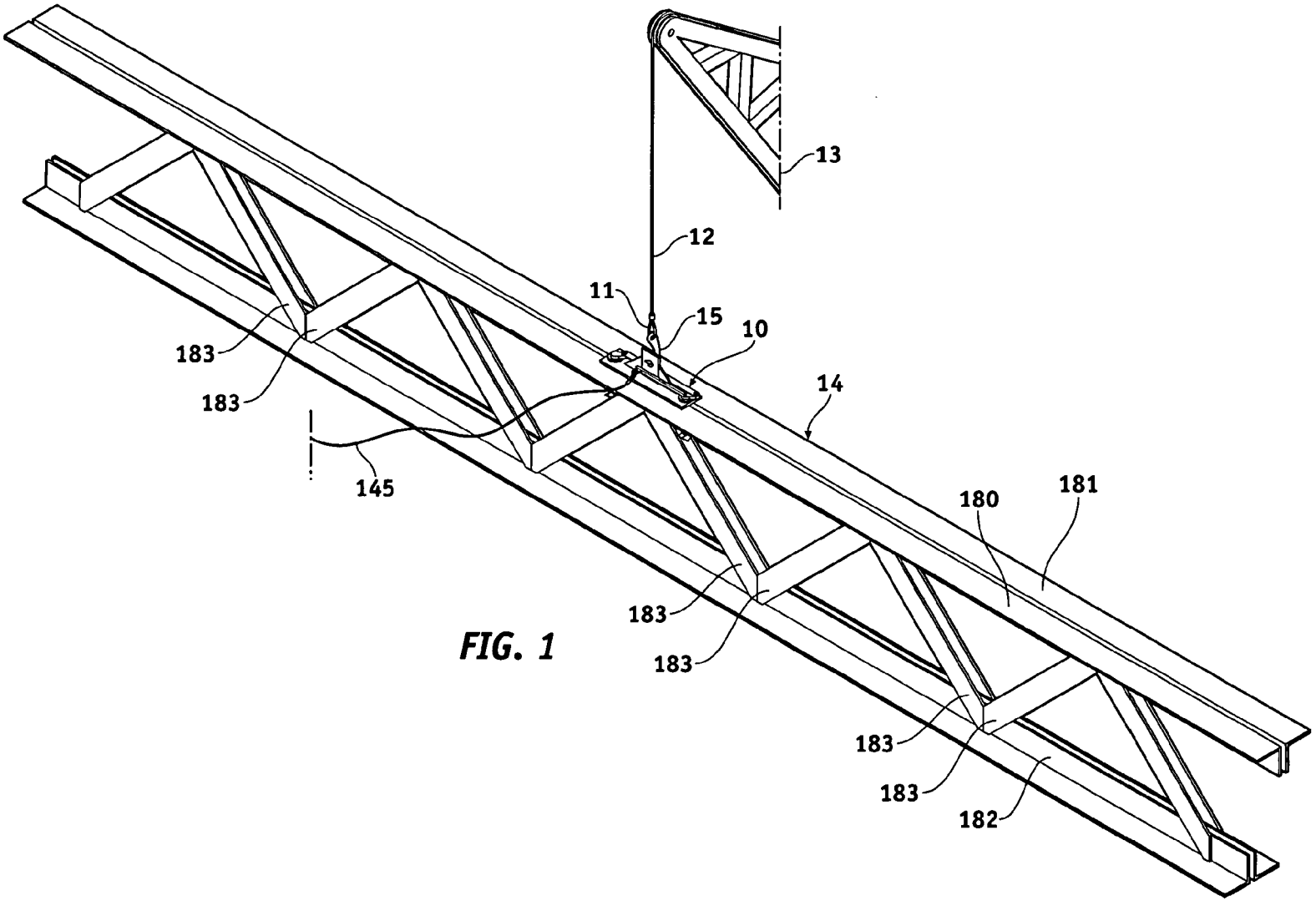
FIG. 1 is a perspective view of a rigging device shown as it would appear securing a beam in a lifting operation, the rigging device constructed and arranged in accordance with the principle of the invention.

Turning now to the drawings, in which like reference characters indicate corresponding elements throughout the several views, attention is first directed to FIG. 1, in which there is seen a rigging device 10 coupled between a business end 11 of a hoist line 12 managed by a crane 13 that is only partially shown, and a truss or beam 14 securing business end 11 of hoist line 12 to beam 14 in a lifting operation. In the present embodiment, business end 11 of hoist line 12 is formed with a hook 15 that hookingly secures rigging device 10, further details of which will be discussed later in this specification.

Figure 2:
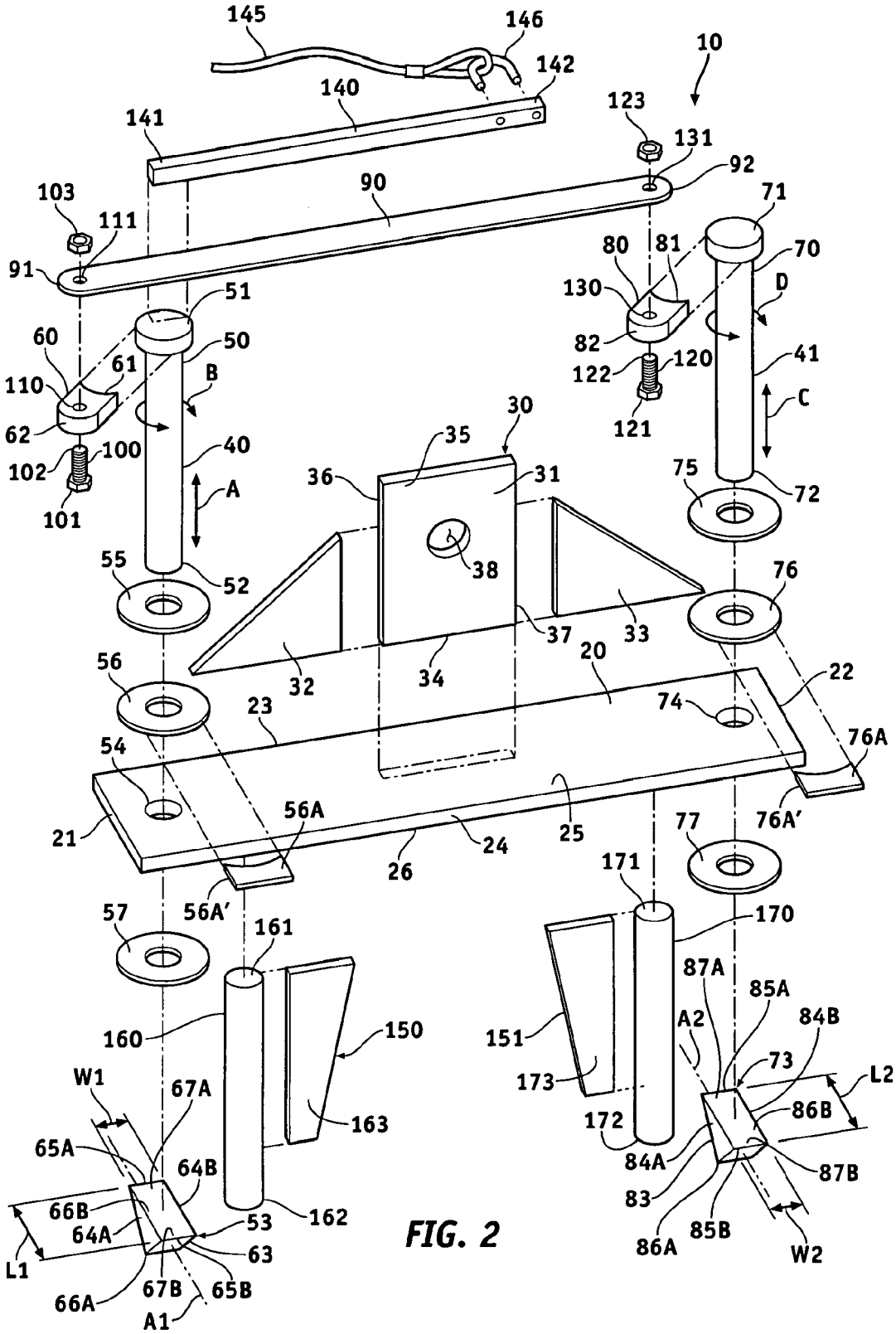
FIG. 2 is an exploded perspective view of the rigging device of FIG. 1.

Referencing FIG. 2, rigging device 10 is constructed of steel, aluminum, or other strong, rugged, resilient metal, metal alloy, or the like, and consists of an elongate fixture 20 having opposed ends 21 and 22, opposed sides 23 and 24, and opposed upper and lower surfaces or faces 25 and 26. Fixture 20 is base of rigging device 10 to which the various components thereof are attached or carried. In the present embodiment, fixture 20 is a generally flat, rectangular plate, in which end 21 is parallel to end 22, side 23 is parallel to side 24, and upper face 25 is parallel to lower face 26. A bracket 30 is secured to upper face 25 of fixture 20 at a generally intermediate or central position between ends 21 and 22, and between sides 23 and 24. Bracket 30 is used to secure business end 11 of hoist line 12 illustrated in FIG. 1, and extends upwardly and away from upper face 25 of fixture 20. Bracket 30 is preferably welded to upper face 25 of fixture 20. Bracket 30 may be integrally formed with upper face 25 of fixture 20, if desired, such as with molding, machining from a single piece of stock, etc. Bracket 30 can be formed with or otherwise secured to fixture 20 in any suitable manner to form a strong, competent attachment or association therebetween.

In the present embodiment, bracket 30 consists of a central, upstanding member 31 flanked on either side by opposed gussets 32 and 33. Gusset 32 is directed toward side 21 of fixture 20, and gusset 33 is directed toward side 33 of fixture 20. Upstanding member 31 has a lower end 34 affixed to upper face 25 of fixture 20 and extends upwardly therefrom to an upper end 35, and has opposed sides 36 and 37 extending from lower end 34 to upper end 35. An opening 38, to receive hook 15 of hoist line 12 illustrated in FIG. 1, is formed in upstanding member 31 proximate to upper end 35 of upstanding member 31 between sides 36 and 37. Gussets 32 and 33 are affixed between upper face 25 of fixture 20 and sides 36 and 37, respectively, of upstanding member 31 providing bracket 30 with structural rigidity and strength. Gusset 32 forms a first side of bracket 30 directed toward end 21 of fixture 20, and gusset 33 forms an opposed second side of bracket 30 directed toward end 22 of fixture 20.

Bracket 30 is adapted to secure business end 11 of hoist line, in this instance with a hook 15 attached to business end 11 of hoist line 12 that is received through opening 38 to hookingly secure rigging device 10 to business end 11 of hoist line 12. Any suitable complementing engagement mechanism or engagement pairs can be formed between bracket 30 and business end 11 of hoist line 12 to secure business end 11 of hoist line 12 to bracket 30.

With continuing reference to FIG. 2, rigging device 10 is fashioned with opposed, parallel, elongate lugs or supports 40 and 41. Supports 40 and 41 reside in a common vertical plane parallel relative to lower face 26 of fixture 20, and are substantially coextensive or otherwise substantially equal in size and shape. Support 40 is mounted to fixture 20 proximate to end 21 of fixture 20 between the first side of bracket 30 formed by gusset 32 and end 21 of fixture 20 and between sides 23 and 24 of fixture 20. Support 41 is mounted to fixture 20 proximate to end 22 of fixture 20 between the second side of bracket 30 formed by gusset 33 and end 22 of fixture 20 and between sides 23 and 24 of fixture 20.

Support 40 is elongate and generally cylindrical in shape like a dowel, and include a first or upper extremity 50 formed with an enlarged head 51, and an opposed second or lower extremity 52 formed with an engaging element 53 to engage a load to be lifted. An opening 54 is formed through fixture 20 proximate to end 21 of fixture 20 between end 21 of fixture 20 and the first side of bracket 30 formed by gusset 32. Support 40 extends through opening 54 locating fixture 20 between upper extremity 50 and lower extremity 52, in which a first length of support 40 extends upwardly away from upper face 25 of fixture 20 to upper extremity 50 formed with head 51, and a second length extends or otherwise depends downwardly from lower face 25 of fixture 20 to lower extremity 52 formed with engaging element 53. The first length of support 40 extending upwardly from upper face 25 of fixture 20 to upper extremity 50 formed with head 51 is shorter than the second length of support 40 extending downwardly from lower face 26 of fixture 20 to lower extremity 52 formed with engaging element 53. In this respect, head 51 formed in upper extremity 50 of support 40 opposes and is in relatively close proximity to upper face 25 of fixture 20, and engaging element 53 formed in lower extremity 52 of support 40 opposes and is spaced apart from lower face 26 of fixture 20.

Support 40 is captured in opening 54 formed in fixture 20 for rotation relative to fixture 20. In this specific embodiment, a pair of opposed washers 55 and 56 encircle support 40 between head 51 and upper face 25 of fixture 20, and a washer 57 encircles support 40 in opposition to lower face 26 of fixture 20 between lower face 26 of fixture 20 and lower extremity 52 of support 40. Washer 55 is positioned against the underside of head 51 and is positioned atop washer 56 that confronts and engages upper face 25 of fixture 20 and which is rigidly secured to upper face 25 of fixture 20, such as by welding. Washer 57 encircles support 40 and confronts lower face 26 of fixture 20 and is rigidly affixed to support 40, such as by welding. If desired washers 55 and 57 may be integrally formed with support 40.

Washer 55 confronts washer 56 rigidly secured to upper face 25 of fixture 20, and washer 57 confronts lower face 26 of fixture 20, and the rigid securement of washers 55 and 57 to support 40 opposite washer 56 and lower face 26 of fixture 20, respectively, captures and secures support 40 relative to fixture 20, and support 40 is free to rotate in opening 54 relative to fixture 20. A gap formed between washers 55 and 57 provides play between washer 55 and washer 56 and between washer 57 and lower face 26 of fixture 20, which provides a limited amount of movement of support 40 in reciprocal directions as indicated by the double arrowed line A along the elongate axis of support 40 extending from upper extremity 50 of support 40 to lower extremity 52 of support 40, which axis of support 40 is perpendicular relative to lower face 26 of fixture 20.

Washer 56 is formed with an abutment or tongue 56A directed toward side 24 of fixture 20, which has an abutment surface or abutment 56A' directed toward end 21 of fixture 20. Support 40 is fashioned with an elongate arm 60, having an inner end 61 affixed to head 51, and which extends laterally outward therefrom parallel relative to upper face 25 of fixture 20 to an outer end 62.

Figure 3:
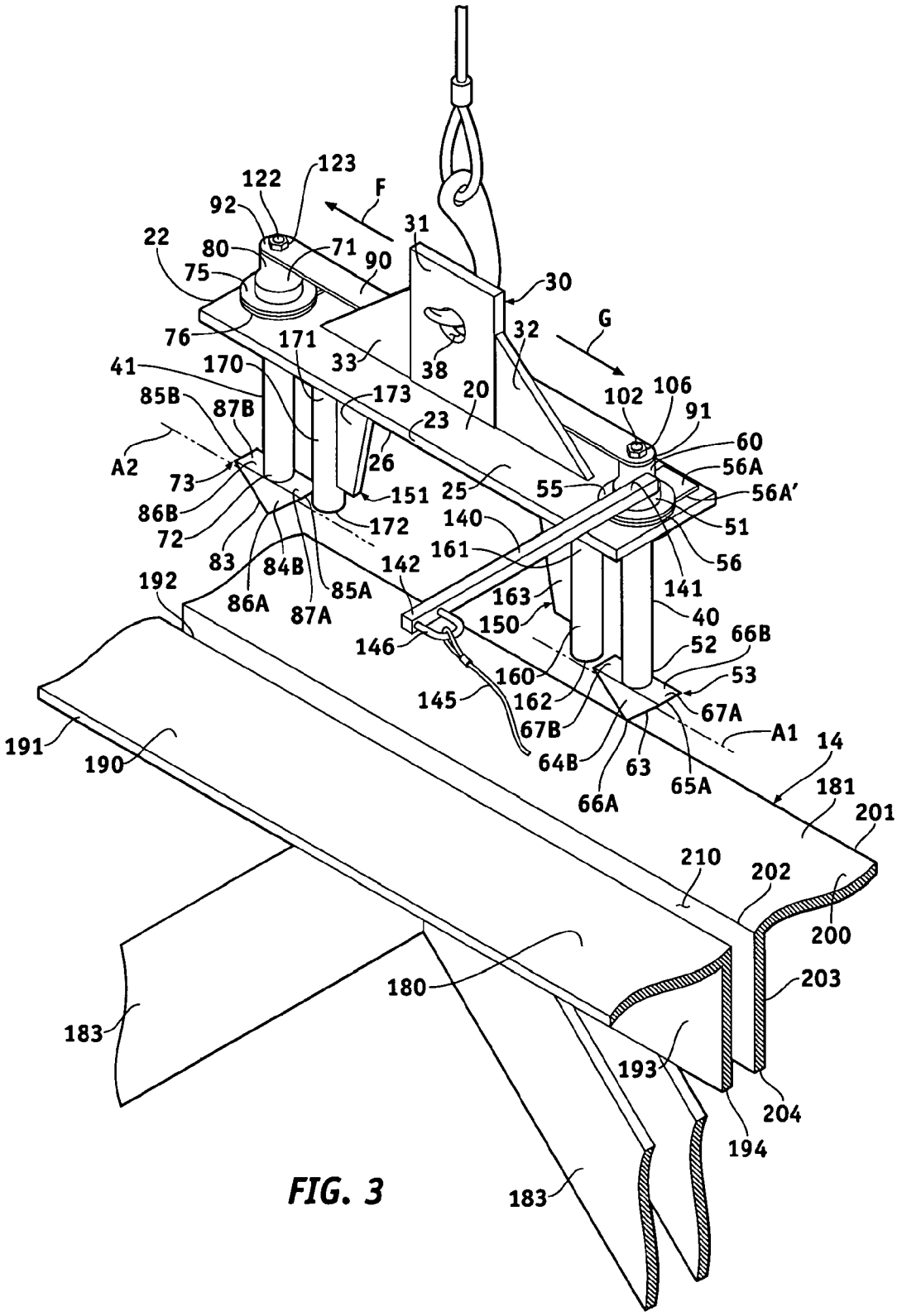
FIG. 3 is a perspective view of the rigging device of FIG. 1 shown as it would appear on approach to a beam in a lifting operation.
Figure 4:
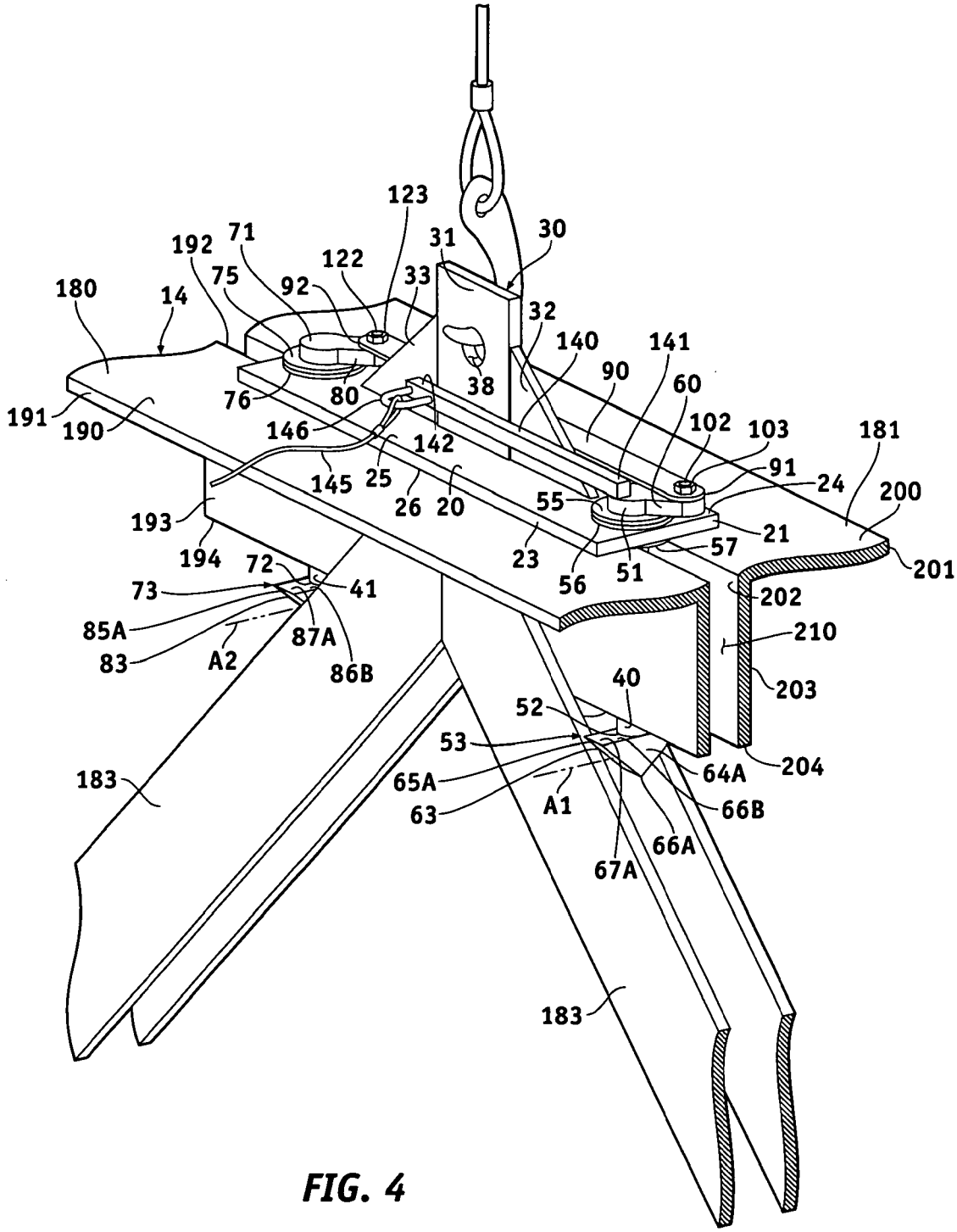
FIG. 4 is a perspective view of the rigging device of FIG. 1 shown as it would appear in preparation for engagement to a beam in a lifting operation.

Support 40 is perpendicular relative to lower face 26 of fixture 20, and also to upper face of fixture 20 in this embodiment. Support 40 is free to rotate in opening 54 relative to fixture 20 as indicated by the arcuate double arrowed line B between a first, starting, or open position disposing engaging element 53 in an open, starting, or disengaging position as illustrated in FIG. 3, and a closed, ending, or engaging position disposing engaging element 53 in an engaging position as illustrated in FIG. 4. In other words, in the present embodiment, engaging element 53 is movable between the disengaging position as illustrated in FIG. 3 and the engaging position as illustrated in FIG. 4 in response to rotation of support 40 between open and closed positions.

In this embodiment, engaging element 53 consists of an enlarged, triangular-shaped block 63 having opposed, parallel sides 64A and 64B, opposed ends 65A and 65B, a pointed lower end 66A, and an opposed broad upper end 66B affixed to, or otherwise formed with, lower extremity 52 of support 40. Formed in upper end 66B are an abutment surface 67A proximate end 65A and an opposed abutment surface 67B proximate end 65B. Abutment surfaces 67A and 67B extend away from either side of support 40 at lower extremity 52 of support 40, and face upwardly toward lower face 26 of fixture 20. Opposed sides 64A and 64B define the widest width W1 of block 63, and opposed ends 65A and 65B at upper end 66B of block 63 define the longest length L1 of block 63, in which the length L1 of block 63 is greater than the width W1 of block 63.

Support 41 is identical to support 40 in every respect. Like support 40, support 41 is elongate and generally cylindrical in shape like a dowel, and include a first or upper extremity 70 formed with an enlarged head 71, and an opposed second or lower extremity 72 formed with an engaging element 73 to engage a load to be lifted. An opening 74 is formed through fixture 20 proximate to end 22 of fixture 20 between end 22 of fixture 20 and the second side of bracket 30 formed by gusset 33. Support 41 extends through opening 74 locating fixture 20 between upper extremity 70 and lower extremity 72, in which a first length of support 41 extends upwardly away from upper face 25 of fixture 20 to upper extremity 70 formed with head 71, and a second length extends or otherwise depends downwardly from lower face 25 of fixture 20 to lower extremity 72 formed with engaging element 73. The first length of support 41 extending upwardly from upper face 25 of fixture 20 to upper extremity 70 formed with head 71 is shorter than the second length of support 41 extending downwardly from lower face 26 of fixture 20 to lower extremity 72 formed with engaging element 73. In this respect, head 71 formed in upper extremity 70 of support 41 opposes and is in relatively close proximity to upper face 25 of fixture 20, and engaging element 73 formed in lower extremity 72 of support 41 opposes and is spaced apart from lower face 26 of fixture 20.

Support 41 is captured in opening 74 formed in fixture 20 for rotation relative to fixture 20. In this specific embodiment, a pair of opposed washers 75 and 76 encircle support 41 between head 71 and upper face 25 of fixture 20, and a washer 77 encircles support 41 in opposition to lower face 26 of fixture 20 between lower face 26 of fixture 20 and lower extremity 72 of support 41. Washer 75 is positioned against the underside of head 71 and is positioned atop washer 76 that confronts and engages upper face 25 of fixture 20 and which is rigidly secured to upper face 25 of fixture 20, such as by welding. Washer 77 encircles support 41 and confronts lower face 26 of fixture 20 and is rigidly affixed to support 41, such as by welding. If desired washers 75 and 77 may be integrally formed with support 41.

Washer 75 confronts washer 76 rigidly secured to upper face 25 of fixture 20, and washer 77 confronts lower face 26 of fixture 20, and the rigid securement of washers 75 and 77 to support 40 opposite washer 76 and lower face 26 of fixture 20, respectively, captures and secures support 41 relative to fixture 20, and support 41 is free to rotate in opening 74 relative to fixture 20. A gap formed between washers 75 and 77 provides play between washer 75 and washer 76 and between washer 77 and lower face 26 of fixture 20, which provides a limited amount of movement of support 41 in reciprocal directions as indicated by the double arrowed line C along the elongate axis of support 41 extending from upper extremity 70 of support 41 to lower extremity 72 of support 41, which axis of support 41 is perpendicular relative to lower face 26 of fixture 20.

Washer 76 is formed with an abutment or tongue 76A directed toward side 24 of fixture 20, which has an abutment surface or abutment 76A' directed toward end 22 of fixture 20. Support 41 is fashioned with an elongate arm 80, having an inner end 81 affixed to head 71, and which extends laterally outward therefrom parallel relative to upper face 25 of fixture 20 to an outer end 82.

Support 41 is perpendicular relative to lower face 26 of fixture 20, and also to upper face of fixture 20 in this embodiment. Support 41 is free to rotate in opening 74 relative to fixture 20 as indicated by the arcuate double arrowed line D between a first, starting, or open position disposing engaging element 73 in an open, starting, or disengaging position as illustrated in FIG. 3, and a closed, ending, or engaging position disposing engaging element 73 in an engaging position as illustrated in FIG. 4. In other words, in the present embodiment, engaging element 73 is movable between an open or disengaging position as illustrated in FIG. 3 and a closed or engaging position as illustrated in FIG. 4 in response to rotation of support 41 between open and closed positions.

In this embodiment, engaging element 73 consists of an enlarged, triangular-shaped block 83 having opposed, parallel sides 84A and 84B, opposed ends 85A and 85B, a pointed lower end 86A, and an opposed broad upper end 86B affixed to, or otherwise formed with, lower extremity 72 of support 41. Formed in upper end 86B are an abutment surface 87A proximate end 85A and an opposed abutment surface 87B proximate end 85B. Abutment surfaces 87A and 87B extend away from either side of support 41 at lower extremity 72 of support 41, and face upwardly toward lower face 26 of fixture 20. Opposed sides 84A and 84B define the widest width W2 of block 63, and opposed ends 85A and 85B at upper end 86B of block 63 define the longest length L2 of block 63, in which the length L2 of block 63 is greater than the width W2 of block 63.

Blocks 63 and 83 are substantially equal in size and shape, in which length L1 of block 63 is substantially equal to length L2 of block 83, and width W1 of block 63 is substantially equal to width W2 of block 83. For orientation purposes, block 63 defines an axis A1 extending along length L1 of block 63 from end 65A to end 65B, and block 83 defines an axis A2 extending along length L2 of block 83 from end 85A to end 85B.

In accordance with the principle of the invention, supports 40 and 41. An initial position of supports 40 and 41 is supports 40 and 41 positioned in their open positions disposing engaging elements 53 and 73 of supports 40 and 41 in their corresponding open/disengaging positions. Support 40 is operatively coupled to support 41, whereby rotation of support 40 imparts concurrent rotation to support 41 to concurrently move engaging elements 53 and 73 of supports 40 and 41 between their respectively open/disengaging and closed/engaging positions, respectively, in response to rotation of supports 40 and 41 between their respective open and closed positions. As such, engaging elements 53 and 73 move concurrently between their open/disengaging and closed/engaging positions in response to the concurrent movement of supports 40 and 41 between their open and closed positions, respectively.

In the disengaging positions of blocks 63 and 83, axis A1 of block 63 is substantially coincident with axis A2 of block 83 as illustrated in FIG. 3. In the engaging positions of blocks 63 and 83, axis A1 of block 63 is substantially parallel with axis A2 of block 83 as illustrated in FIG. 4. In the present embodiment, upper extremity 50 of support 40 is operatively coupled to upper extremity 70 of support 41. A linkage 90 coupled between outer ends 62 and 82 of arms 60 and 80, respectively, forms the operatively coupling between supports 40 and 41, and, more particularly, between upper extremity 50 of support 40 and upper extremity 70 of support 41.

Linkage 90 is elongate and rigid, and has a first end 91 pivotally coupled to outer end 62 of arm 60 formed in upper extremity 50 of support 40, and an opposed second end 92 pivotally coupled to outer end 82 of arm 80 formed in upper extremity 70 of support 41. Linkage 90 is supported by and between outer ends 62 and 82 of arms 60 and 80 at a location overlying and parallel to upper face 25 of fixture 20 on one side of bracket 30. In the present embodiment a threaded bolt 100 extends concurrently through corresponding openings 110 and 111, respectively, formed in ends 62 and 91 of arm 60 and linkage 90, respectively, and has an enlarged head 101 received against the underside of arm 60 confronting upper face 25 of fixture 20 and an opposed threaded free end 102 extending upwardly relative to first end 91 of linkage 90 that secures a corresponding threaded nut 103, which is tightened to secure threaded bolt 100 in place. A threaded bolt 120 extends concurrently through corresponding openings 130 and 131, respectively, formed in ends 82 and 92 of arm 80 and linkage 90, respectively, and has an enlarged head 121 received against the underside of arm 80 confronting upper face 25 of fixture 20 and an opposed threaded free end 122 extending upwardly relative to second end 92 of linkage 90 that secures a corresponding threaded nut 123, which is tightened to secure threaded bolt 100 in place.

In the disengaging positions of engaging elements 53 and 73 of supports 40 and 41, supports 40 and 41 are each positioned in their respective open positions, whereby engaging elements 53 and 73 are disposed in their respective open/disengaging positions as illustrated in FIG. 3, and arms 60 and 80 extend outwardly toward side 24 of fixture 20 and are angled toward end 22 of fixture 20 as substantially illustrated in FIG. 3. From this initial or starting position of supports 40 and 41, rotation of support 40 in a first rotational direction from its open position to its closed position, which imparts corresponding and concurrent rotation to support 41 from its open position to its closed position through the operatively coupling of support 40 to support 41 with linkage 90, moves or otherwise rotates engaging elements 53 and 73 of supports 40 and 41 from their respectively open/disengaging positions to their respective closed/engaging positions, whereby arms 60 and 80 move across side 24 of fixture 20 from end 22 of fixture 20 toward end 21 of fixture 20 in the direction indicated by the arrowed line E in FIG. 3.

In the closed/engaging positions of engaging elements 53 and 73 of supports 40 and 41, supports 40 and 41 are similarly positioned relative to each other as illustrated in FIG. 4, and arms 60 and 80 extend outwardly toward side 24 of fixture 20 and are angled toward end 21 of fixture 20 as substantially illustrated in FIG. 4. From the closed/engaging positions of engaging elements 53 and 73, rotation of support 40 in a second rotational direction opposite to that of the first rotational direction from its closed position to its open position, which imparts corresponding and concurrent rotation to support 41 from its closed position to its open position through the operatively coupling of support 40 to support 41 with linkage 90, moves or otherwise rotates engaging elements 53 and 73 of supports 40 and 41 from their respectively closed/engaging positions to their respective open/engaging positions, whereby arms 60 and 80 move across side 24 of fixture 20 from end 21 of fixture 20 toward end 22 of fixture 20 in the direction indicated by the arrowed line F in FIG. 3.

Referencing FIG. 2, rigging device 10 is fashioned with a lever 140. Lever 140 is formed of steel, aluminum, or other strong rigid material or combination of materials, is elongate, and has an inner affixed to upper extremity 50 of support 40, and extends outwardly therefrom to an opposed outer end 142. Inner end 141 is attached to upper extremity 50 of support 40 with welding or by integrally forming inner end 141 of lever 140 with upper extremity 50 of support 40. If desired, a mechanical coupling utilizing any suitable mechanical fastener or mechanism may be used to affix inner end 141 of lever 140 to upper extremity 50 of support 40. For convenience and ease of operation, outer end 142 of lever 140 may be taken up, such as by hand, and moved side-to-side between an open position as illustrated in FIG. 3 and a closed position as illustrated in FIG. 4 to move supports 40 and 41 between their open and closed positions, respectively, for, in turn, moving engaging elements 53 and 73 between their respective open/disengaging and closed/disengaging positions. In the open position of lever 140 illustrated in FIG. 3, lever 140 extends outwardly from fixture 20 away from side 23. In the closed position of lever 140 illustrated in FIG. 4, lever 140 is moved toward fixture 20 and extends across fixture 20 above upper face 25 between ends 21 and 22 on the side of bracket 30 opposing the side of bracket 30 linkage 90 extends.

With continuing reference to FIG. 2, rigging device 10 is provided with opposed, substantially coextensive, parallel guides 150 and 151, which are formed along lower face 26 of fixture 20 between supports 40 and 41. Guide 150 is located adjacent to support 140, and guide 151 is located adjacent to support 141. Guides 150 and 151 are somewhat short in length than the length of supports 40 and 41 extending below lower face 26 of fixture 20, are parallel relative to supports 40 and 41, and reside in a vertical plane that is common to the common vertical plane in which supports 40 and 41 reside. Guide 150 consists of an elongate, cylindrical member 160 having an upper end 161 affixed to lower face 26 of fixture 20, and depends downwardly therefrom to a lower end 162. Member 160 is flanked on one side by a gusset 163. Gusset 163 is directed toward guide 151 away from support 40, and is affixed between lower face 26 of fixture 20 and member 160 providing guide 150 with structural rigidity and strength. Similarly to guide 150, guide 151 consists of an elongate, cylindrical member 170 having an upper end 171 affixed to lower face 26 of fixture 20, and depends downwardly therefrom to a lower end 172. Member 170 is flanked on one side by a gusset 173. Gusset 173 is directed toward guide 150 away from support 41, and is affixed between lower face 26 of fixture 20 and member 170 providing guide 151 with structural rigidity and strength.

Rigging device 10 is useful in lifting loads and, in particular, girders, trusses, beams, and the like, such as truss or beam 14 depicted in FIG. 1. Beam 14 is a convention steel, roof truss or beam including opposed, elongate, parallel upper supports 180 and 181, an elongate lower support 182, and bracing 183 formed therebetween rigidly coupling upper supports 180 and 181 to lower support 181. Referencing FIG. 4, upper support 180 consists of a horizontal support or plate 190 having an outer edge 191 and an opposed parallel inner edge 192. An upright support or plate 193 depends downwardly from inner edge 192 of plate 190 and terminates with a lower edge 194 positioned below and opposing and parallel to inner edge 192. Upper support 181 is the mirror image of upper support 180, and includes a horizontal support or plate 200 having an outer edge 201 and an opposed parallel inner edge 202 spaced from an opposing inner edge 192 of plate 190. An upright support or plate 203 depends downwardly from inner edge 202 of plate 190 and terminates with a lower edge 204 spaced from and opposing lower edge 194 of upper member 180, and which is positioned below and opposes and is parallel to inner edge 202. Upright supports or plates 193 and 203 are spaced-apart and parallel relative to each other forming a channel 210, having a width W3, therebetween extending from inner edges 192 and 202 to lower edges 194 and 204. Width W3 of channel 210 is greater that width W1 of block 63, and is greater than width W2 of bock 83.

In use in a lifting operation with reference to FIG. 3, rigging device 10 is affixed to business end 11 of hoist line 11 by passing hook 15 into and through opening 39 formed in bracket 30. At this point, supports 40 and 41 are rotated to their open positions to position engaging elements 53 and 73 in their respective open/disengaging positions as illustrated in FIG. 3. In the disengaging positions of engaging elements 53 and 73 as illustrated in FIG. 3, lever 140 is pivoted into its open position extending away from side 23 of fixture 20. Hoist line 12 is maneuvered by crane 13 (shown only in FIG. 1), positioning rigging device 10 above upper supports 180 and 181 of beam 14 to register blocks 63 and 83 and supports 40 and 41 with channel 210, in which widths W1 and W2 (referenced only in FIG. 2) of blocks 63 and 83, and lengths L1 and L2 (referenced only in FIG. 2) of blocks 63 extending along axes A1 and A2, respectively, are each normal to, or otherwise aligned relative to, the width W3 and length of channel 210. Because guides 150 and 151 reside in a common vertical plane with supports 40 and 41 extending downwardly from lower face 26 of fixture 20, registration of supports 40 and 41 extending downwardly from lower face 26 of fixture 20 with channel 210 registers guides 150 and 151 with channel 210.

At this point, hoist line 12 is maneuvered to lower rigging device 10 onto beam 14 presenting blocks 63 and 83 and supports 40 and 41 extending downwardly from lower face 26 of fixture 20, and also guides 150 and 151, into and through channel 210 until blocks 63 and 83 pass below lower edges 194 and 204 of upper supports 180 and 181 and lower face 26 of fixture 20 is applied against the upper faces of plates 190 and 200, respectively. Guides 150 and 151 help guide rigging device 10 into placement with channel 210. Supports 40 and 41 extending downwardly from lower face 26 of fixture 20 to blocks each have a diameter or width less than width W3 formed in beam 14 to allow supports 40 extending downwardly from lower face 26 of fixture 20 to blocks 63 and 83 to readily pass into and through channel 210 in both the disengaging positions of blocks 63 and 83 and the engaging positions of blocks 63 and 83. However, blocks 63 and 83 cannot pass into and through channel 210 in the engaging positions of blocks 63 and 83 because the length L1 of block 63 and the length L2 of block 83 are each greater than width W3 of beam 14. Guides 150 and 151 extending downwardly from lower face 26 of fixture 20 each also have a diameter or width less than width W3 formed in beam 14 to allow guides 150 and 151 extending downwardly from lower face 26 of fixture 20 to readily pass into and through channel 210.

After positioning rigging device 10 onto beam 14 as described, supports 40 and 41 are rotated, such as with the use of lever 140, to move supports 40 and 41 from their open positions to their closed positions as illustrated in FIG. 4 to move blocks 63 and 83 from their respective open/disengaging positions to their respective closed/engaging positions below lower edges 194 and 204 of upper supports 180 and 181. Again, this is preferably carried out simply by taking up outer end 142 of lever 140 and moving lever 140 from its open position as illustrated in FIG. 3 to its closed position as illustrated in FIG. 4 to impart rotation to supports 40 and 41 from their open positions to their closed positions. In the engaging positions of engaging elements 53 and 73 as illustrated in FIG. 4, lever 140 is pivoted inwardly toward bracket 30, in which widths W1 and W2 of blocks 63 and 83, and lengths L1 and L2 of blocks 63 extending along axes A1 and A2, respectively, are each perpendicular to, or otherwise extend across, the width W3 of channel 210. In the engaging position of block 63, abutment surface 67A extending away from one side of lower extremity 52 of support 40 opposes and is registered with lower edge 194 of upper support 180, and abutment surface 67B extending away from the opposing side of lower extremity 52 of support 40 opposes and is registered with lower edge 204 of upper support 180. In the engaging position of block 83, abutment surface 87A extending away from one side of lower extremity 72 of support 41 opposes and is registered with lower edge 194 of upper support 180, and abutment surface 87B extending away from the opposing side of lower extremity 72 of support 41 opposes and is registered with lower edge 204 of upper support 180, which completes the installation of rigging device 10 relative to beam 14.

Figure 5:
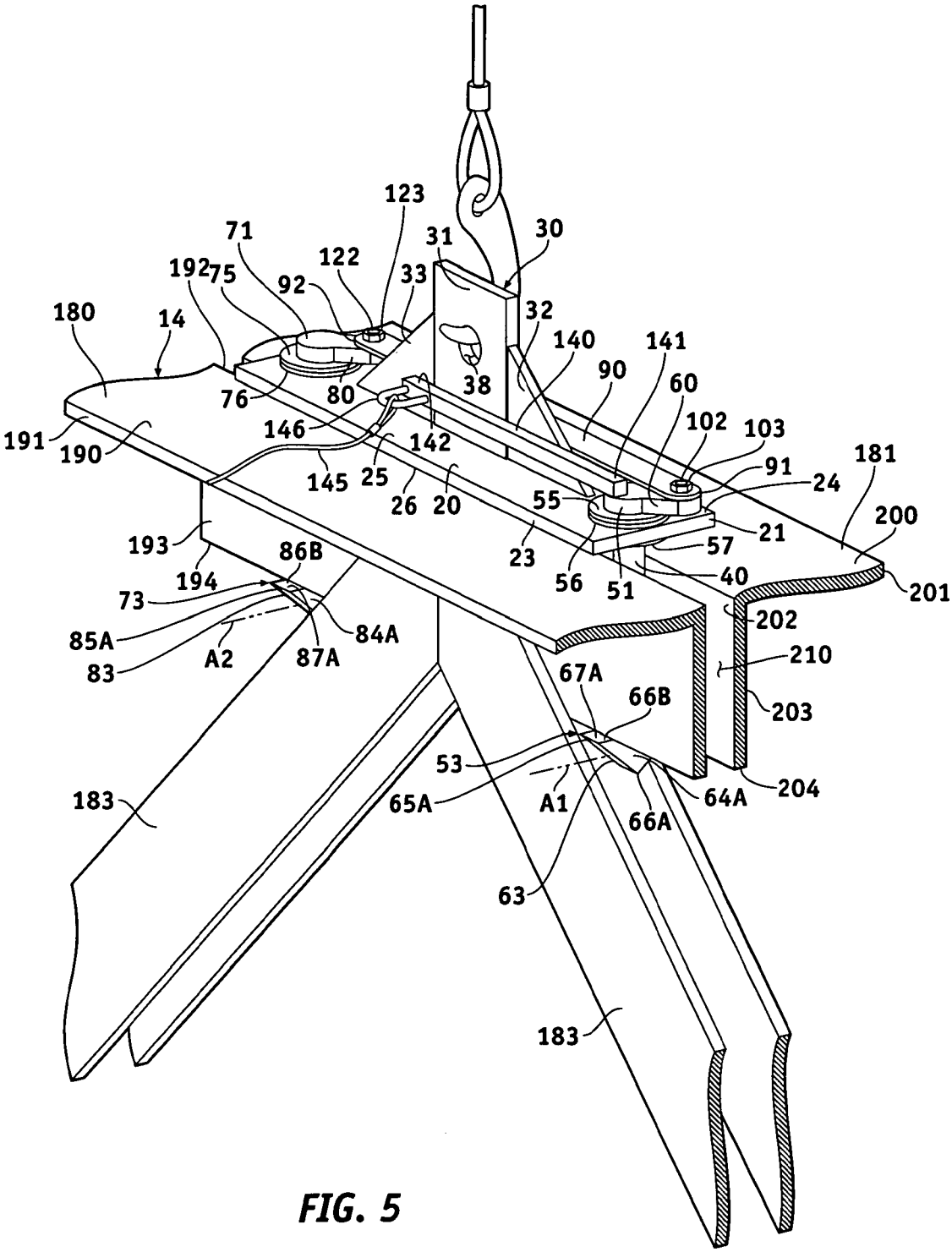
FIG. 5 is a view very similar to that of FIG. 4 illustrating the rigging device engaged to the beam in the lifting operation.

At this point in the lifting operation, hoist line 12 is maneuvered to lift rigging device 10 upwardly away from upper supports 180 and 181 of beam 14, which draws blocks 63 and 83 upwardly toward lower edges 194 and 204 and brings abutment surfaces 67A and 67B of block 63 into engagement against lower edges 194 and 204, respectively, of upper supports 180 and 181, and which brings abutment surfaces 87A and 87B of block 83 into engagement against lower edges 194 and 204, respectively, of upper supports 180 and 181, evenly taking up the load of beam 14, as illustrated in FIG. 5, as hoist line 12 continues to lift rigging device 10. The installation of rigging device 10 with beam 14 and the engagement and fitting of blocks 63 and 83 of rigging device 10 relative to beam 14 together taking up the load of beam 14 as herein specifically described securely couples beam 14 to rigging device 10 and thus hoist line 12 to beam 14, whereby hoist line 12 may then be maneuvered by the crane to lift and position beam 14 as desired. To release rigging device 10 from beam 14 after a lifting operation the above-described operation of installing rigging device 10 to beam 14 need only be reversed.

Figure 6:
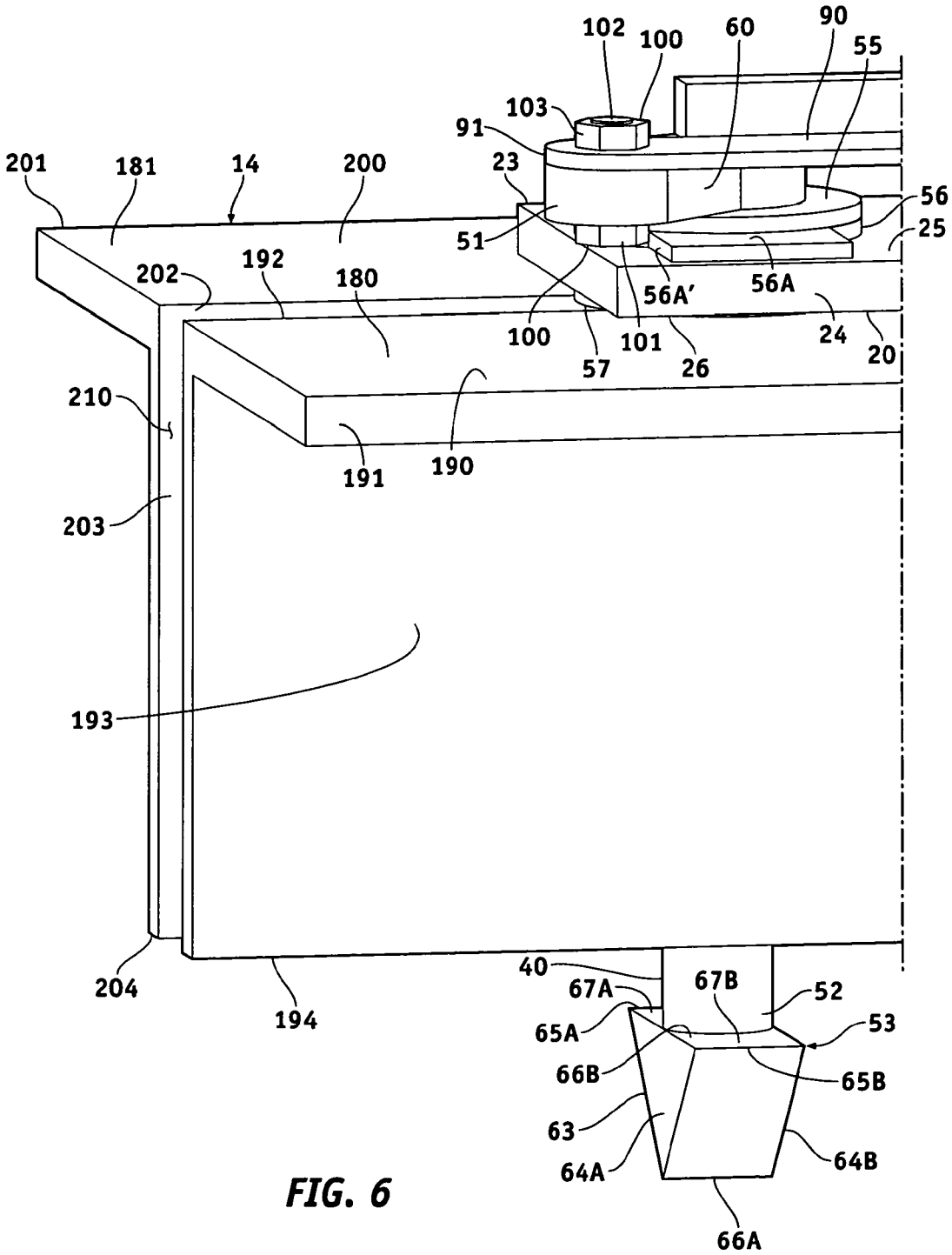
FIG. 6 is an enlarged fragmented perspective view of a beam and of the rigging device of FIG. 1 shown as it would appear in preparation for engagement to the beam in a lifting operation.

Referencing FIG. 6, rigging device 10 is shown with block 63 forming engaging element 53 of support 40 in the engaging position underneath and opposing lower edges 194 and 204 of upper supports 180 and 181. In this position, head 101 of threaded bolt 100 forming the pivotal coupling between outer end 62 of arm 60 and end 91 of linkage 90 is positioned somewhat above and on an outer side of, or otherwise outboard of, abutment 56A' of tongue 56A of washer 56. The reciprocal moveability of support as indicated by the double arrowed line A in FIG. 2 allows a shifting of support 40 downwardly toward upper face 25 of fixture to apply head 101 downwardly to confront abutment 56A' of tongue 56A of washer 56 rigidly affixed to upper face 25 of fixture 20.

As such, in response to application of a load applied to block 63 in lifting beam 14 with rigging device 10, the reciprocal moveability of support as indicated by the double arrowed line A in FIG. 2 causes support 40 to shift or displace downwardly away from lower face 26 of fixture 20 applying head 101 downwardly toward upper face 25 of fixture 20 to confront abutment 56A' of tongue 56A of washer 56 rigidly affixed to upper face 25 of fixture 20. In this application, as a load is taken up against and borne by block 63 in a direction away from lower face 26 of fixture 20 in the lifting of a load with rigging device 10 in a lifting operation, head 101 opposes abutment 56A' and acts an abutment that interacts with abutment 56A' to preventing rotation of support 40 from the engaging position of block 63 to the disengaging position of block 63 effectively locking support 40 in the engaging position of block 63, in accordance with the principle of the invention. Because of the operative coupling between supports 40 and 41, this locking of support 40 in the engaging position of block 63 also locks support 41 in the engaging position of block 83, in accordance with the principle of the invention. This is a safety feature to prevent supports 40 and 41 from rotating and moving blocks 63 and 83 from the engaging positions to the disengaging positions in a lifting operation that would otherwise case a beam being lifting from disengaging from supports 63 and 83 and falling. After a load is released from support 40 after a lifting operation, support 40 may be maneuvered upwardly to bring head 101 out of its abutting relationship with abutment 56A' to permit rotation of support 40, and thus support 41, from the engaging position of block 63 to the disengaging position of block 63. Nevertheless, like support 40 and for redundancy for enhanced safety, head 121 of threaded bolt 120 in conjunction with support 41 functions identically with respect to abutment 76A' of tongue 76A of washer 76 as illustrated in FIG. 2, in which the foregoing discussion of head 101 and abutment 56A' in conjunction with support 40 applies to head 121 and abutment 76A' in conjunction with support 41.

Rigging device 10 incorporates two opposed lugs or supports 40 and 41, and less or more can be used, if desired. Further, a plurality of rigging devices 10 may be used concurrently in a lifting operation, if desired. Abutment surfaces 67A and 67B of block 63 and abutment surfaces 87A and 87B of block 83 can be furnished with texturing or rubber or elastomeric overlays to providing a gripping engagement with a load to be lifted. Rigging device 10 can be installed relative to a beam to be lifted and then attached to a hoist line in a lifting operation.

As illustrated in FIGS. 2-5, outer end 142 of lever 140 is attached to an operating line 145, which may be used to pull lever 140 from into its open position from its closed position to release rigging device 10 from beam 14 upon completing of a lifting operation in the event access to rigging device 10 is limited. In the present embodiment, outer end 142 of lever 140 is fashioned with an eye 146 to which operating line 145 is attached, although line 145 can be secured to outer end 142 of lever 140 in any desired or suitable manner.

If desired, a bias can be applied, such as with one or more installed springs or resilient bumpers or cams or the like, between support 40 and fixture 20 to bias head 101 away from a confronting or abutting relationship relative to abutment 56A', which bias is overcome in the application of a load applied to support 40 in a lifting operation to permit displacement of support 40 to move head 101 into a confronting or abutting relationship with abutment 56A'. Like support 40, a bias can be applied, such as with one or more installed springs or resilient bumpers or cams or the like, between support 41 and fixture 20 to bias head 121 away from a confronting or abutting relationship relative to abutment 76A', which bias is overcome in the application of a load applied to support 41 in a lifting operation to permit displacement of support 41 to move head 121 into a confronting or abutting relationship with abutment 76A'. Still further, a bias can be applied, such as with one or more installed springs or resilient bumpers or cams or the like, between support 40, and/or, support 41, and/or linkage 90, and/or lever 140, to bias supports 40 and 41 in their respective closed positions to prevent supports 40 and 41 from inadvertently moving out of their respective closed positions in a lifting operation.

Figure 7:
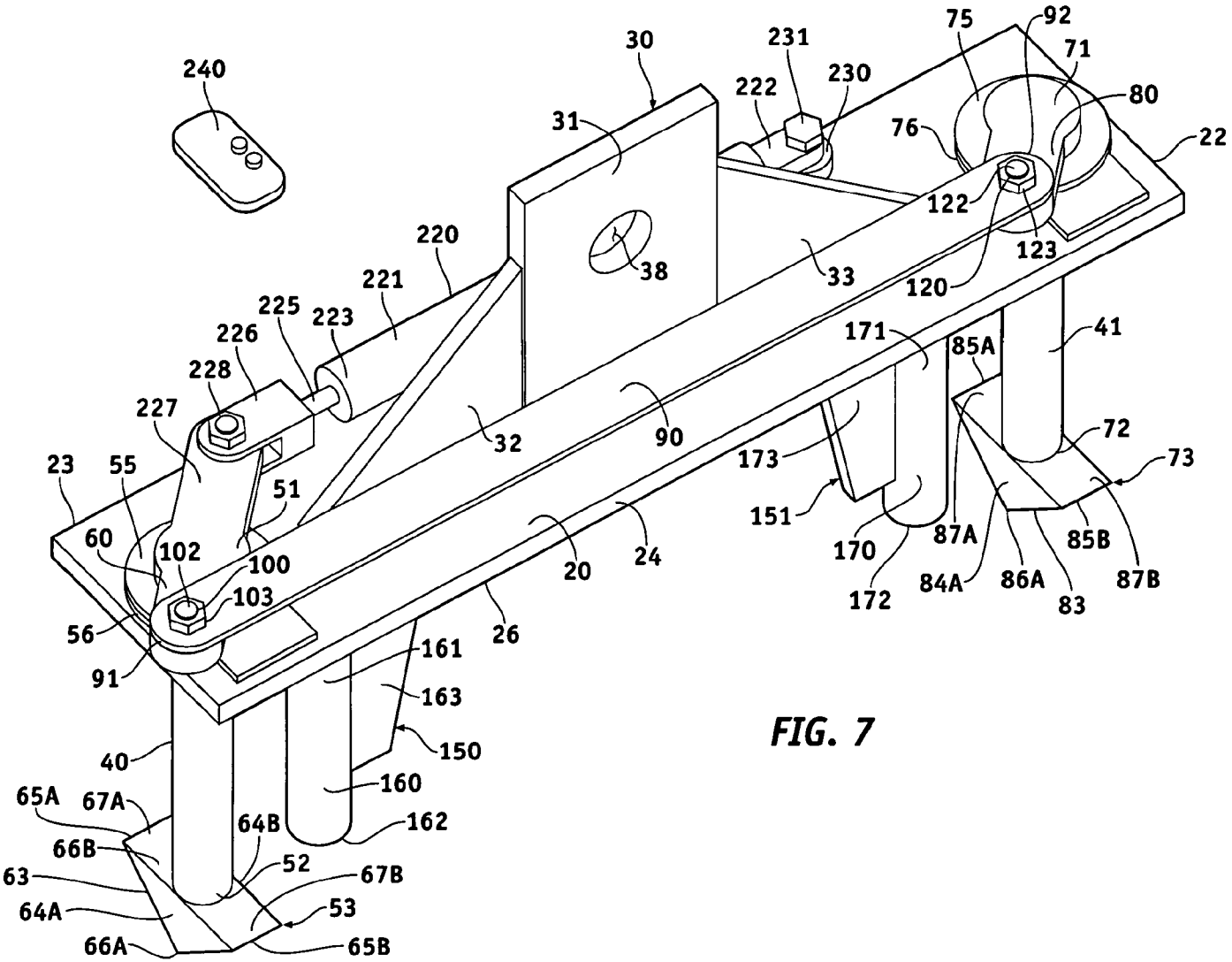
FIG. 7 is a perspective view of a rigging device constructed and arranged in accordance with an alternate embodiment of the invention.

In the preferred embodiment disclosed herein, lever 140 is preferred in applying rotation to support 40 to, in turn, concurrently rotate supports 40 and 41. If desired, lever 140 can be secured to support 41. Referencing FIG. 7, rigging device 10 is illustrated with a piston or cylinder assembly 220 in lieu of lever 140 forming an exemplary embodiment of the invention. In this embodiment, cylinder assembly 220 overlies upper face 25 of fixture 20 and is positioned between bracket 30 and side 23 of fixture 20, whereas linkage 90 is positioned on the opposing side of bracket 30 between bracket 30 and side 24 of fixture 20. Cylinder assembly 220 is a conventional hydraulic or pneumatic cylinder assembly and includes a cylinder 221 having an inner end 222 directed toward end 22 of fixture 20 which is mounted for pivotal movement to a block 230 affixed to, and extending upwardly from, upper face 25 of fixture 20 with a bolt or pin 231. Cylinder 221 extends toward end 21 of fixture 20 from inner end 222 to an outer end 223. An operating rod 225 is mounted partially within cylinder 221 through outer end 223 for reciprocal movement therein and leads to an outer end 226 mounted for pivotal movement to an extension 227 affixed to head 51 of upper extremity 50 of support 40 extending laterally outward from head 51 in a direction opposite to the of arm 60. In the present embodiment outer end 226 of operating rod 225 is mounted for pivotal movement to extension 227 with a nut and bolt assembly 228, although a pivot pin or other form of pivotal attachment or joint can be used, if desired.

In operation, cylinder assembly 220 actuates and moves operating rod 25 between retracted and extended positions relative to outer end 223 of cylinder 221, and acts on extension 227 to, in turn, impart rotation to support 40 between its open and open positions, which imparts corresponding and concurrent rotation to support 41 between its open and closed position through the operatively coupling of support 40 to support 41 with linkage 90. Actuation of cylinder assembly 220 can be made manually, or through the use of a remote control device 230 operatively coupled to cylinder assembly 220.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A rigging device, comprising:

a. a rigid fixture configured and arranged for lifting engagement by a hoist fine of a crane;

b. a support attached to the fixture wherein the support, (i) is operable for rotation about a vertical axis relative to the fixture when the fixture is suspended from a hoist line of a crane as between an engaged and a disengaged position, and, (ii) is operable for reciprocation along the vertical axis as between an up position and a down position;

c. an engaging element on a distal end of the support extending different distances from the vertical axis in each of two orthogonal radial axes;

d. wherein rotation of the support between the engaged and disengaged positions is allowed when the support is in the up position and rotation of the support from the engaged to the disengaged positions is prevented when the support is in the down position;

e. a second support horizontally spaced from the first support;

f. an operative coupling between the supports, wherein rotation of one of the supports imparts rotation to the other one of the supports; and g. a lever attached to one of the supports to rotate the one of the supports, in which the operative coupling between the supports imparts rotation of the other one of the supports in response to rotation of the one of the supports with the lever.

2. The rigging device according to claim 1, further comprising a linkage coupled between the supports forming the operative coupling between the supports.

* * * * *